United States Patent [19]

Lewis et al.

[11] Patent Number: 5,014,457

[45] Date of Patent: May 14, 1991

[54] SAFE WEAPONS SYSTEM FOR A FIREARM

[76] Inventors: Hogan G. Lewis, P.O. Box 58, Middle St., Kelford; Charles E. Gregory, Jr., P.O. Box 31, Oak City, both of N.C. 27857

[21] Appl. No.: 351,804

[22] Filed: May 15, 1989

[51] Int. Cl.[5] ..... F41A 17/44

[52] U.S. Cl. ..... 42/70.11

[58] Field of Search ..... 42/70.11, 96

[56] References Cited

U.S. PATENT DOCUMENTS

| | | |
|---|---|---|
| 2,530,560 | 11/1950 | Young . |
| 3,193,959 | 7/1965 | Jaycox . |
| 3,678,609 | 7/1972 | Fazio . |
| 4,023,294 | 5/1977 | Knopp . |
| 4,512,099 | 4/1985 | Mathew . |
| 4,776,123 | 10/1988 | Ascroft . |

*Primary Examiner*—Deborah L. Kyle

*Assistant Examiner*—Richard W. Wendtland

*Attorney, Agent, or Firm*—Rhodes, Coats & Bennett

[57] ABSTRACT

The present invention entails a safe weapons system for a firearm. In particular, the safety system of the present invention comprises a non-fireable slug specifically designed to be received and accepted within a firing chamber forming a part of the firearm. The non-fireable slug includes an outer cylindrical tapered wall that is generally tapered to conform to the taper of the firing chamber itself and the slug is specifically sized such that it is designed to assume to seized or secured position within the firing chamber intermediately between opposed end portions of the firing chamber. Safety is realized because of the position occupied by the slug within the firing chamber. The position occupied by the slug within the firing chamber makes it practically impossible for the firearm to be chambered with a live ammunition round.

12 Claims, 4 Drawing Sheets

SAFE WEAPONS SYSTEM FOR A FIREARM

FIELD OF THE INVENTION

The present invention relates to firearms, and more particularly to safety devices incorporated into firearms.

BACKGROUND OF THE INVENTION

Safety has always been a principle concern of firearm manufacturers and owners alike. Because of this concern, there has been over the years much attention directed towards incorporating safety devices into firearm designs. These safety devices have been of various types and of various particular designs. Most any gun enthusiast is familiar with the various mechanical safeties incorporated into firearms. Besides the various mechanical safeties, it has been known to utilize a non-firing cartridge or slug within certain portions of the firearm itself. For example, see the disclosure found in U.S. Pat. No. 4,776,123.

But generally, firearm safety devices of the prior art have been of the type that can be readily seen or are obvious to a person having the firearm in his hands. Expressed in another way, conventional safety devices can be turned on and off by the flick of a finger. Even with slugs or dummy cartridges, they are most often designed to be placed in the firearm in an obvious and conspicuous position allowing for the safety (whether mechanical or of the slug type) made inoperative by an inquisitive and probing child, for example.

While it is true that conventional mechanical firearm safeties and even conventional slug type safeties do have utility, there are certain situations where they are not effective. In this regard, it should be noted that in recent years there have been a rash of gun shop robberies that have been accompanied by the gun shop operator or custodian being murdered. Ironically in these cases, the gun shop operator is fatally injured with a gun that he or she is demonstrating to whom he or she thinks is a potential customer. Because of the frequency of gun shop robberies and associated shootings involving the very firearm being shown, there is a need to provide a safe weapons system that will protect gun shop owners and operators while they are showing various firearms within the shop.

Therefore, there has been and continues to be a need for a firearm safety device that does not have the drawbacks and shortcomings of conventional and mechanical safeties and which is particularly designed to assume a hidden and non-conspicuous position within the firearm itself.

SUMMARY AND OBJECTS OF THE INVENTION

The present invention entails a firearm safety device that is intended to overcome the drawbacks and shortcomings of prior firearm safety devices, and which can be manufactured and sold relatively inexpensively.

The present invention provides for a safety device in the form of a non-fireable slug that is designed to assume a hidden position within the firing chamber of a particular firearm. Once in this hidden position, it is practically impossible for the firearm to be chambered. Thus, the device of the present invention is in fact a safe weapons system.

In particular, the present invention entails a non-firing slug that is particularly designed to be compatible with a wide number of particular firearms. The non-fireable slug is designed to seat within the firing chamber, intermediately between the opposed ends within the firing chamber. When seated, the slug assumes a position generally hidden from view such that the firearm in all respects looks conventional and normal. But because of the particular position of the slug within the firing chamber, the firearm cannot be loaded with a live ammunition round.

It is therefore an object of the present invention to provide a safe weapons system for a firearm that is practical, effective, and economical.

A further object of the present invention entails the provision of an insert type safe weapons system for a firearm that when inserted into the firearm and positioned in an operative mode cannot be readily detected by an observer or one holding the firearm.

Still a further object of the present invention resides in the provision of a safe weapons system of the character referred to above that permits a relatively few different sized slugs to fit a wide range of different types and size firearms, thereby making the insert safety device extremely economical and practical.

Another object of the present invention resides in the provision of an insert type safety device for a firearm that is provided with means for readily dislodging the slug from the firing chamber such that the firearm can be quickly made operative.

It is also an object of the present invention to provide an insert slug type safety device that is designed to be totally compatible with the firearm itself and which is particularly designed such that the safety slug will not scar or otherwise damage the firearm and particularly the firing chamber thereof.

Other objects and advantages of the present invention will become apparent and obvious from a study of the following description and the accompanying drawings which are merely illustrative of such invention.

DETAILED DESCRIPTION OF THE INVENTION

Figure 1:
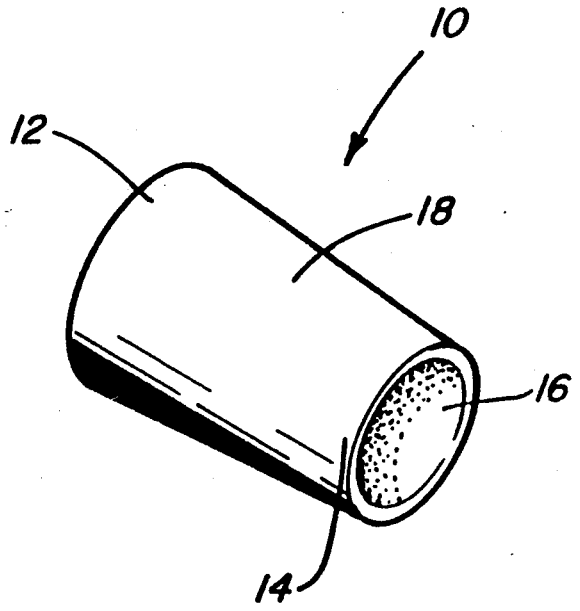
FIG. 1 is a perspective view of the slug forming a part of the safe weapons system of the present invention.

With further reference to the drawings, the safe weapons system of the present invention is shown therein and includes a non-fireable slug indicated generally by the numeral 10. As will be more fully understood from subsequent portions of this disclosure, the non-fireable slug 10 is designed to be accepted and secured within a firing chamber of a firearm.

Referring to the slug 10, it is seen that the same is elongated and includes an aft end portion 12 and a fore end portion 14. Formed in the fore end portion 14 is a locator cavity 16.

As seen in the drawings, slug 10 includes a cylindrical wall structure 18. The cylindrical wall 18 is very slightly tapered inwardly from the aft end 12 towards the fore end 14. As for the degree of taper, it is contemplated that the slug 10 would be tapered approximately 0.005 inches per inch of length.

As noted above, slug 10 is designed to be received and accepted within a firing chamber of various type firearms including pistols, shotguns, etc. As seen in the drawings, for purposes of illustration, a pistol is shown in FIG. 2 while a shotgun is depicted in FIG. 3.

In any event, the firearm includes at least one firing chamber that is indicated by the numeral 20. Each firing chamber includes an inlet end 20*a*, an outlet end 20*b* and a tapered inner cylindrical wall 20*c*.

Figure 2:
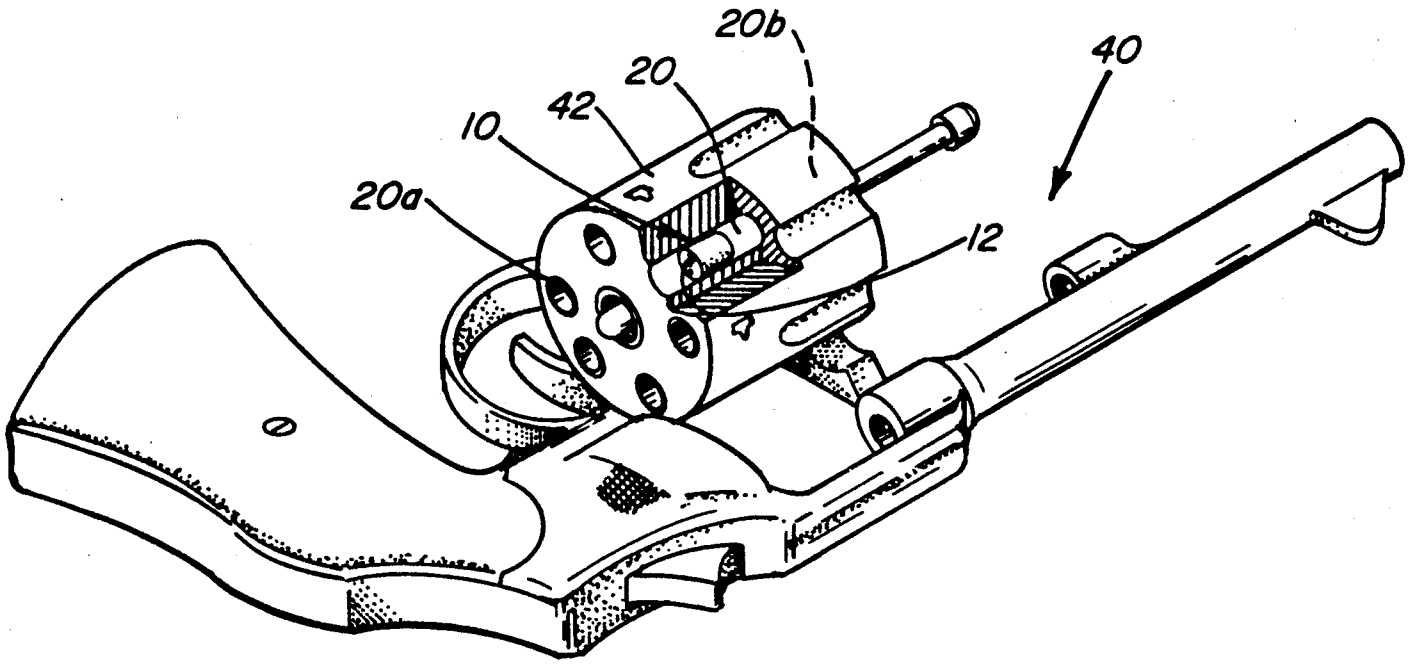
FIG. 2 is a perspective view of a pistol showing the insertion of the slug into a firing chamber.

In FIG. 2, there is illustrated a pistol indicated generally by the numeral 40. Pistol 40 includes a conventional revolving cylinder 42. Cylinder 42 is provided with a series of circumferentially spaced firing chambers 20. A portion of the outer structure around one firing chamber is removed to better illustrate the firing chamber and the relationship of slug 10 seized therein. Because the inner cylindrical wall 20*c* is tapered and because of the corresponding taper of the slug 10, it is seen that the slug assumes a secured or seized position within the firing chamber 20 intermediately between the inlet end 20*a* and the outlet end 20*b*. As seen in FIG. 2, there is an open space defined between the aft end 12 of the slug 10 and the inlet end 20*a* of the firing chamber 20. This space prevents the particular firing chamber from being chambered with a conventional live ammunition round. In essence, the space defined between the inlet end 20*a* and the aft end of slug 10 is insufficient to accommodate the conventional live ammunition round made for that particular firearm. Put in another way, if a conventional live ammunition round is attempted to be inserted within the firing chamber that contains the slug 10 then a rear portion of the live ammunition round will project out the inlet end of the firing chamber to such a degree that the pistol cylinder 42 cannot be closed.

Figure 3:
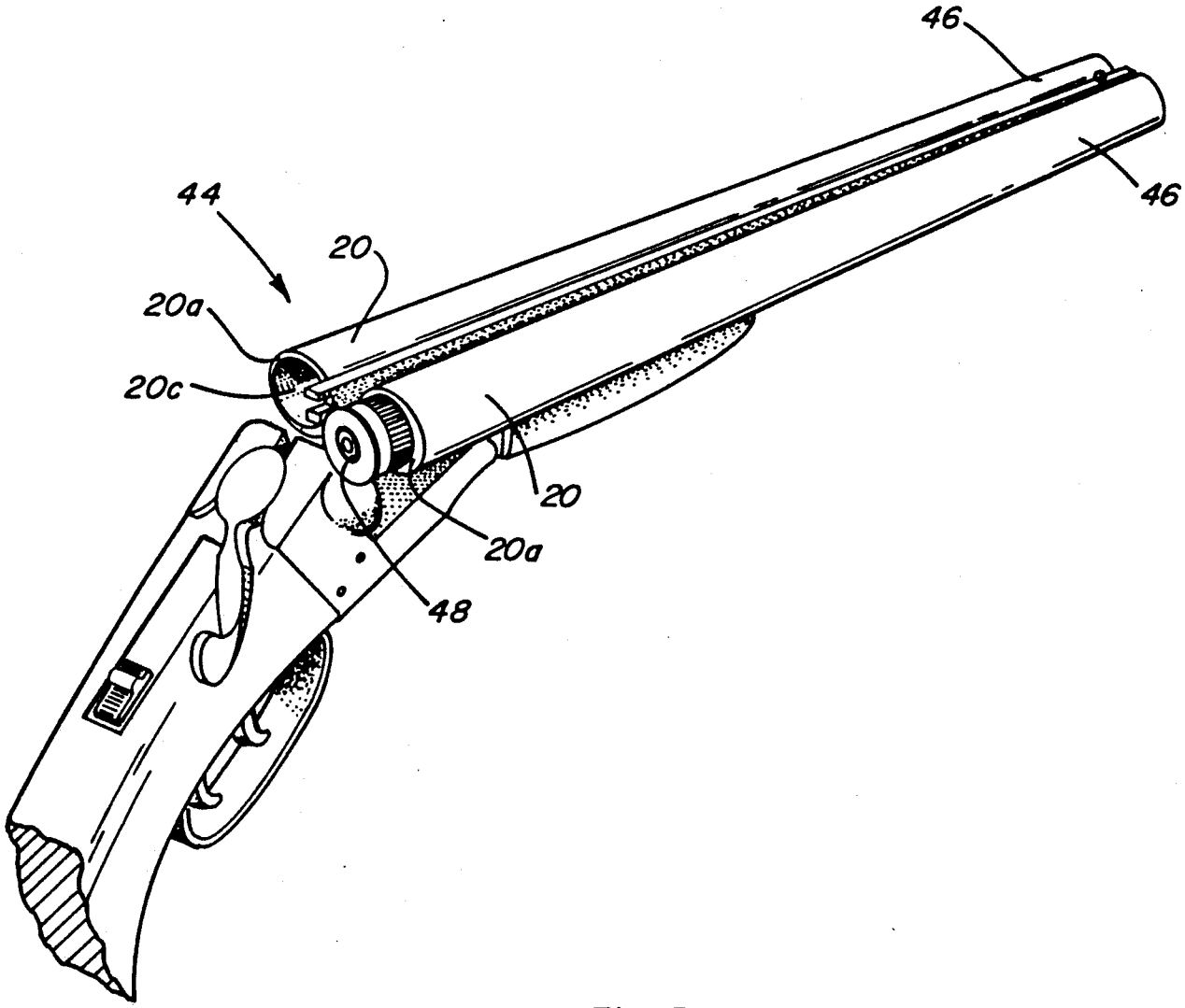
FIG. 3 is a fragmentary perspective view of a shotgun in an open position illustrating the position occupied by an appropriate shotgun shell when that shell engages the slug of the present invention.
Figure 4:
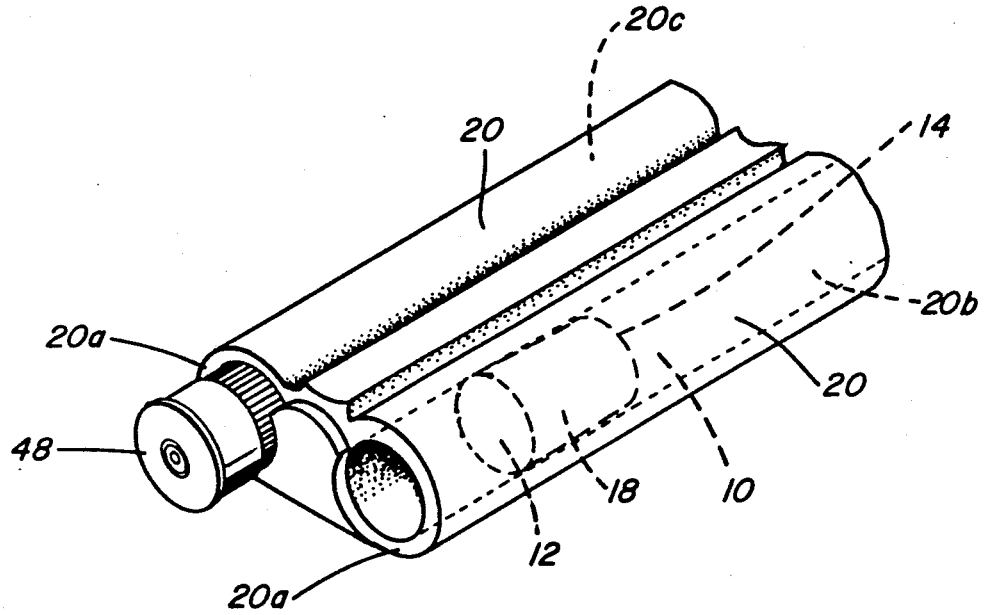
FIG. 4 is a perspective fragmentary view of the firing chambers of a conventional shotgun showing the slug in a seized position within one of the firing chambers.

Now turning to FIGS. 3 and 4, there is shown therein a double-barrel shotgun indicated generally by the numeral 44. Shotgun 44 includes a pair of elongated barrels 46. Each of the barrels includes its own firing chamber 20 that in conventional fashion forms an extension of the barrels.

As was the case with pistol 40 described herein above, slug 10 is designed to be seized within the firing chambers 20 of the shotgun 44. In FIG. 4, there is an illustration showing slug 10 seized within the right hand firing chamber. In the left hand firing chamber there is also a slug 10, but it is not specifically shown. But the presence of the slug 10 in the left hand chamber prevents a conventional shotgun shell or cartridge 48 from being properly chambered in that firing chamber. Note in FIG. 4 that the presence of the slug 10 within the left hand firing chamber prevents shell 48 from being pushed or moved further into the firing chamber 20. Again, the open space defined between the aft end portion 12 of the slug 10 and the inlet 20*a* of the firing chamber 20 is insufficient to accept the appropriate size ammunition round for that particular firearm.

In FIG. 3, there is a like illustration, but with the illustration showing a shell 48 that cannot be fully pushed or move into the right hand firing chamber 20 because of the presence of a slug (not shown) being properly seized within that same firing chamber. It is noted in FIG. 3 that when the shell 48 engages the slug in the firing chamber that the rear portion of the shell 48 projects rearwardly to such a degree that the shotgun 44 cannot be closed.

Figure 5:
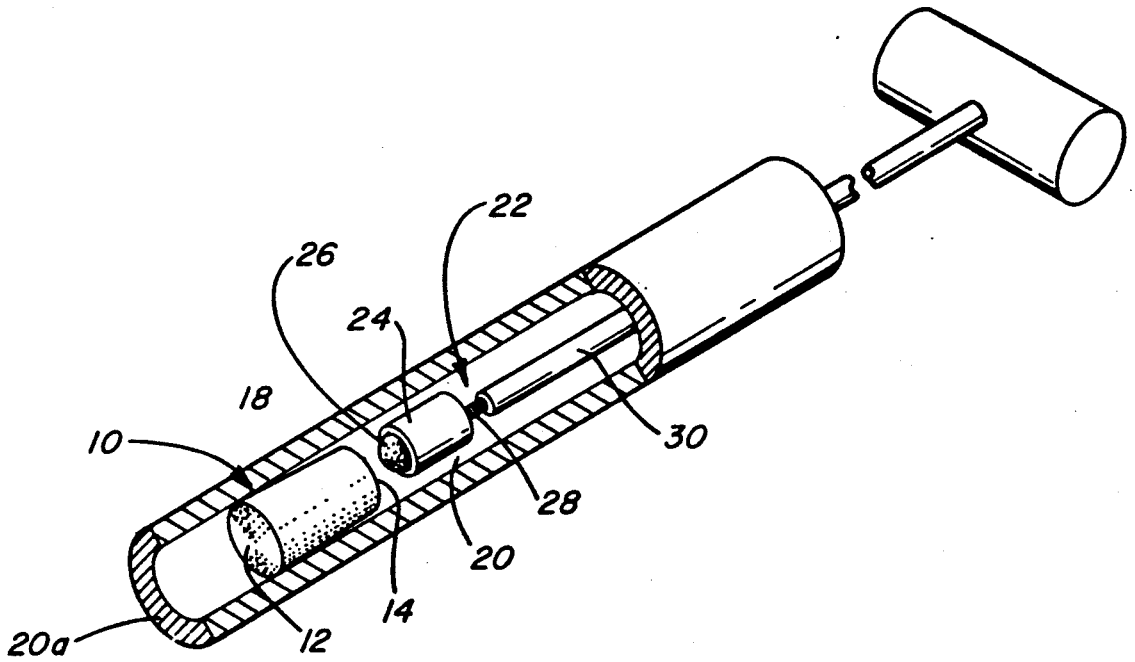
FIG. 5 is a fragmentary perspective view of a firearm firing chamber with portions broken away to illustrate the slug of the present invention and a slug removal tool utilized to dislodge the slug from the firing chamber.

Now turning to FIG. 5, there is shown therein a slug removal tool indicated generally by the numeral 22. The slug removal tool 22 includes a guide or leading section 24 that includes a forwardly projecting locator dome 26. Locator dome 26 is designed to mate with the concave cavity 16 formed in the fore portion of the slug 10. Extending from the rear side of guide 24 is a threaded shaft 28 that is designed to be secured within the remote end of a conventional cleaning rod 30.

It is appreciated that to dislodge slug 10 from a seized position within the firing chamber 20, that the cleaning rod 30 can be extended into and through the outlet end 20*c* of the firing chamber 20 to where the locator dome 26 engages the concave cavity 16 of the slug. Thereafter, by applying pressure against the slug 10, one can dislodge the same from the firing chamber 20 and remove the slug 10 through the inlet end 20*a* of the firing chamber 20.

A very important advantage of the slug design disclosed herein lies in the fact that a slug can be designed in size such that it will fit a large number of firing chambers for different firearms. Thus, this enables one to produce a few different sized slugs but yet accommodate a wide range of firearms. More particular, the diameter and taper of the slug is designed to correspond to the diameter and taper of the ammunition specifically designed for a number of particular weapons. The length of the slug 10 is not designed to correspond to the length of the appropriate ammunition. The length of a slug will be based on the length of the shortest live ammunition round designed for the specified group of firearms. For example, the case diameter and taper is essentially the same for a .38 Special, .357 Magnum, and .357 Maximum. But the length of these three rounds varies substantially. Because the .38 Special is the shortest in length, the length of the slug is determined in accordance with the length of the round for the .38 Special. In particular, in the design of the present invention, the slug 10 is made a length approximately two-thirds of the total length of the shortest round having the same general diameter and taper. This enables the slug to appropriately fit within any firing chamber designed to accept this group of ammunition rounds.

In this regard, it should be pointed out that there are many different calibers that fall within the same case family. There are many commercial cartridges that were developed from what is known as a parent cartridge. For example the .243 Winchester was originally derived from the .308 Winchester which was derived from the .30/06 Springfield. The .25/06 Remington, .270 Winchester, .280 Remington, 7 mm Express and 8 mm/06 Wildcat were all derived from the .30/06 Springfield which is knows as the parent cartridge. In the case of the present invention, the length of the slug 10 is based on the shortest cartridge of the case family. Again the length of the slug 10 is designed to be approximately two-thirds of the length of the shortest cartridge for a particular cartridge family. It is noted that the length is based on the length from the base of the cartridge to the cartridge shoulder.

Figure 1A:
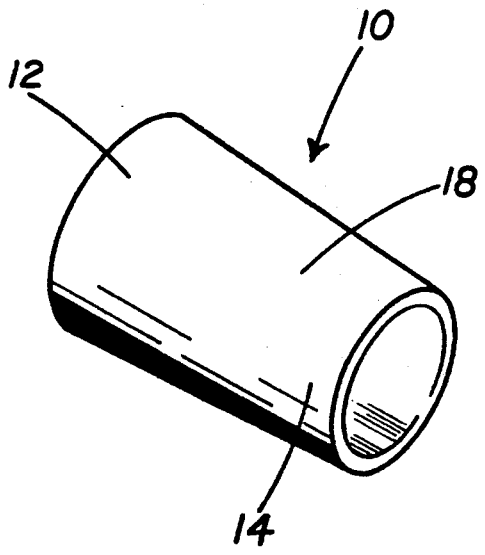
FIG. 1A is a perspective view of the slug in the form of a tapered cylindrical sleeve.

The slug 10 can be made of various materials and can be formed in numerous designs. For example, it is contemplated that the slug 10 could be a tapered cylindric sleeve. A tapered cylindrical sleeve is shown in FIG. 1A. In this case, the slug would be less visible because one would be able to see through the firing chamber and the slug itself. As far as the construction and composition of the slug 10 goes, it is contemplated that it would be comprised of a plastic or relative hard rubber material that would be compatible with the firing chamber itself such that it would not scar, scratch or otherwise damage the firing chamber.

From the foregoing specification and discussion, it is appreciated that the present invention entails a very reliable dependable, and relatively simple safe weapons system for a firearm. The slug of the present invention is designed to assume a position within the firing chamber of a firearm such that that firing chamber cannot be appropriately chambered with a conventional ammunition round. The present invention is especially practical and has substantial utility inasmuch as a single slug can be designed and sized such that it will be compatible with a wide range of different firearms. Consequently, two or three different size slugs can be designed which will fit and accommodate a large number of firearms.

The present invention, may of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A self-wedging single piece firearm safety device specifically adapted to be inserted within a firing chamber having an elongated tapered inner cylindrical wall and opposed end portions that includes an ammunition inlet end, and wherein when inserted within the firing chamber the safety device renders the firearm inoperative, the firearm safety device comprising:

(a) a non-fireable single piece and self-wedging slug adapted to be received within the firing chamber such that the slug becomes stationed intermediately the opposed ends of the firing chamber and consequently prohibits the firing chamber from being chambered with a live ammunition round; and (b) the non-fireable single piece slug having fore and aft ends with the fore end having a spherical depression formed therein, and a fixed non-expandable outer cylindrical tapered wall that is selectively tapered such that it functions independently to wedge and accordingly frictionally secures the singe piece slug within the firing chamber such that as the single piece slug is moved from the inlet end towards the opposite end of the firing chamber the same will become frictionally secured within the firing chamber so as to define an open space in the firing chamber between the slug and the inlet end of the firing chamber with the open space being so sized that a live ammunition round cannot be properly chambered within the firing chamber occupied by the slug.

2. The firearm safety device of claim 1 wherein the slug is constructed of a relatively firm plastic material.

3. The firearm safety device of claim 1 wherein the length of the firing chamber is L and wherein the length of the slug is less than 0.8 L.

4. The firearm safety device of claim 1 wherein the slug includes fore and aft ends and wherein the fore end is provided with a locator cavity and wherein there is provided a slug removal attachment adapted to be converted to an elongated cleaning rod for assisting in removing the slug from the firing chamber, the slug removal attachment and including a cylindrical guide, a slug cavity locator projecting from the slide, and means for attaching the removal tool to an elongated cleaning rod.

5. In a firearm having a firing chamber including an inlet end, an outlet end, and a tapered cylindrical inner wall extending between the inlet and outlet ends, the improvement comprising a single piece firing chamber safety slug that makes chambering the firearm with conventional live ammunition impossible, the single piece safety slug having fore and aft ends, a spherical depression formed in the fore end and a fixed non-expandable tapered cylindrical outer wall, the diameter of cylindrical wall progressively increasing from the fore end towards the aft end and wherein the cylindrical wall is selectively tapered relative to the tapered inner cylindrical wall of the firing chamber such that the single piece slug can be inserted through the inlet end of the firing chamber but is prohibited from passing through the outlet end of the firing chamber but wherein the fixed non-expandable taper of the slug is such that as the single piece slug is moved through the inlet end towards the outlet end of the firing chamber the fixed non-expandable tapered wall automatically wedges in the firing chamber and assumes a seized position intermediately between the outlet and inlet end of the firing chamber; and wherein in the seized position there is defined an open space between the aft ends of the slug and the inlet end of the firing chamber and wherein that open space is particularly defined and sized such that a conventional live ammunition round cannot be placed in that defined space between the aft end of the slug and the inlet end of the firing chamber.

6. The improved firearm of claim 5 including a firing chamber safety slug wherein there is provided a slug removal tool that is compatible with the slug for removing the same from the firing chamber.

7. The improved firearm of claim 6 wherein the slug removal tool includes a cylindrical guide, and means for attaching the cylindrical guide to an elongated rod whereby the cylindrical guide can be urged through the outlet end of the firing chamber into engagement with the seized slug and by exerting a force through the cylindrical guide the slug can be dislodged from its seized position within the firing chamber and can accordingly be removed.

8. The improved firearm of claim 5 wherein the firing chamber is of a selected length L and wherein the slug is of a length 0.2 L–0.8 L.

9. A method of disabling a firearm comprising the steps of: inserting a single piece and self-wedging non-fireable slug having fore and aft ends and a fixed non-expandable tapered cylindrical outer wall into the inlet end of a firing chamber associated with the firearm; maintaining the single piece slug in a non-expandable state and pushing the slug from the inlet end of the firing chamber towards the opposite outlet end of the firing chamber; wedging the fixed non-expandable and selectively tapered cylindrical outer wall in the firing chamber by continuing to move the single piece slug from the inlet end of the firing chamber towards the opposite outlet end of the firing chamber such that the wedging action created between the tapered outer cylindrical wall of the single piece slug and the firing chamber becomes the sole securement securing the wedge within the firing chamber; defining an open space between the aft end of a slug and the inlet end of the firing chamber; securing the slug at a position within the firing chamber intermediately between the inlet and outlet ends such that the defined open space in the firing chamber between the aft end of the slug and the inlet end of the firing chamber is insufficient to accept a live ammunition round thereby making it practically impossible to chamber the firearm when the slug is seized within the firing chamber engaging a spherical depression formed in the fore end of the slug with a slug removal tool and pushing the slug towards and out the inlet end of the firing chamber.

10. The method of claim 9 including the step of dislodging the slug from the firing chamber by inserting a slug removal tool into and through the outlet end of the firing chamber and into engagement with the slug and pushing the slug towards the inlet end of the firing chamber.

11. The method of claim 10 wherein the firing chamber is tapered inwardly from the inlet end towards the outlet end and wherein the method includes tapering the slug inwardly from the aft end portion towards the fore end portion such that the taper generally conforms to the taper of the firing chamber, but wherein the taper of the slug is such that it will seize intermediately between the inlet and outlet ends of the firing chamber.

12. A self-wedging single piece firearm safety device specifically adapted to be inserted within a firing chamber having an elongated tapered inner cylindrical wall and opposed end portions that includes an ammunition inlet end, and wherein when inserted within the firing chamber the safety device renders the firearm inoperative, the firearm safety device comprising: a non-fireable single piece and self-wedging slug adapted to be received within the firing chamber such that the slug becomes stationed intermediately the opposite ends of the firing chamber and consequently prohibits the firing chamber from being chambered with a live ammunition round; the single piece slug including a tapered cylindrical hollow sleeve and wherein the tapered cylindrical sleeve includes a fixed non-expandable cylindrical outer wall and wherein the taper of the outer wall is such that the slug assumes a self-wedging property inasmuch as the taper of the outer wall is such that the slug becomes wedged within the firing chamber as it is moved from the inlet end towards the opposite end and wherein the taper of the cylindrical sleeve slug is solely responsible for wedging the slug within the firing chamber.

* * * * *